US006425830B1

(12) United States Patent
Chou

(10) Patent No.: US 6,425,830 B1
(45) Date of Patent: Jul. 30, 2002

(54) GOLF SWING PRACTICING DEVICE

(76) Inventor: Shih-Chieh Chou, 1F, 1, Alley 16, Lane 40, Jinn Te Rd., Taichung (TW)

( * ) Notice: Subject to any disclaimer, the term of this patent is extended or adjusted under 35 U.S.C. 154(b) by 0 days.

(21) Appl. No.: 09/437,324

(22) Filed: Nov. 8, 1999

(51) Int. Cl.[7] ..... A63B 69/39
(52) U.S. Cl. ..... 473/140; 473/146; 473/149
(58) Field of Search ..... 473/138, 139, 473/140, 141, 143, 146

(56) References Cited

U.S. PATENT DOCUMENTS

| | | | |
|---|---|---|---|
| 2,510,266 | A | 6/1950 | Taylor |
| 3,383,921 | A | 5/1968 | Palmer |
| 4,023,809 | A | 5/1977 | Newton |
| 5,178,393 | A | 1/1993 | Dennesen |
| 5,255,920 | A | 10/1993 | Mangeri |
| 5,513,847 | A | 5/1996 | Hu et al. |
| 6,254,491 | B1 | 7/2001 | Chou |

*Primary Examiner*—Mark S. Graham
*Assistant Examiner*—Raeann Gordon
(74) *Attorney, Agent, or Firm*—Alan Kamrath; Rider, Bennett, Egan & Arundel, LLP

(57) ABSTRACT

A golf swing practicing device includes a light comb member enclosed in a dome member, and a shaft extends through a base plate connected to the dome member and the light comb member. A mounting cap is connected to a top of the shaft extending through the dome member. A flexible rod is rotatably connected to the mounting cap. A golf ball is connected to a distal end of the flexible rod. A sensor is connected to the base plate, and the comb members of the light comb member movably engage between two lugs on the sensor. A display member is connected to the sensor so as to illustrate the information of the golf ball hit by the player.

3 Claims, 5 Drawing Sheets

GOLF SWING PRACTICING DEVICE

FIELD OF THE INVENTION

The present invention relates to a golf swing practicing device which has a shaft connected to a rod which has a golf ball. A light comb member is connected to the shaft and a sensor is located beside the light comb member so that when the ball is hit, the light comb member is rotated and the message is sensed by the sensor and illustrated on a display device.

BACKGROUND OF THE INVENTION

Golf is a popular exercise and requires skill so as to hit the ball in a proper direction and distance. Nevertheless, players have to practice the swing action frequently to let the swing action become fixed and permanent ensuring that the golf ball can be hit properly in each serve. A conventional golf swing practicing device is shown in FIG. 1 and includes a plate 100 having a protrusion portion 101 on which a column 200 extends. A rod 201 extends radially from the column 200, and a golf ball 202 is connected to the distal end of the rod 201. A display device 203 is connected to the top of the column 200 so that the result of the swing hitting the golf ball 202 is calculated and displayed on the display device 203. Noise will be generated from the connection between the rod 201 and the base portion of the column 200 when hitting the golf ball. Furthermore, the friction between the rod 201 and the column 200 is large so that the yards that the golf ball is hit displayed by the programs in the display device 203 is not accurate.

The present invention intends to provide a golf swing practicing device which has a shaft extending through a dome member and a light comb member fixedly connected to the column. A mounting cap is connected to the top of the shaft, and a rod extends from the mounting cap. A golf ball is connected to the rod 79. When the golf ball is hit, the mounting cap is rotated with the shaft and the light comb member is actuated to calculate the direction and force hit on the golf ball so as to illustrate the information on the display device. The present invention has arisen to mitigate and/or obviate the disadvantage of the conventional golf swing practicing device.

SUMMARY OF THE INVENTION

In accordance with one aspect of the present invention, there is provided a golf swing practicing device comprising a board having a handle connected to a side thereof and a base plate connected on the board. A dome member is connected to the board having a hold defined therethrough. A light comb member having a skirt portion with a plurality of comb members is received in the dome member. A tube extends from the skirt portion, and a bearing is mounted to the tube. A shaft extends through the hole in the base plate, through the tube of the light comb member and through a dome member, with a torsion spring being mounted to the shaft. A mounting cap is mounted to a top of the shaft extending through the dome member, and a notch is defined in an end of the mounting cap. A flexible rod is rotatably engaged with the notch, and a golf ball is connected to a distal end of the flexible rod. A sensor is connected to the light comb member, and a display device is connected to the sensor.

The primary object of the present invention is to provide a golf swing practicing device wherein the light comb member is connected to the flexible rod to which a golf ball is connected. The light comb member is engaged with two bearings so that the friction when the light comb member rotates is small.

These and further objects, features and advantages of the present invention will become more obvious from the following description when taken in connection with the accompanying drawings which show, for purposes of illustration only, several embodiments in accordance with the present invention.

DETAILED DESCRIPTION OF THE PREFERRED EMBODIMENTS

Figure 1:
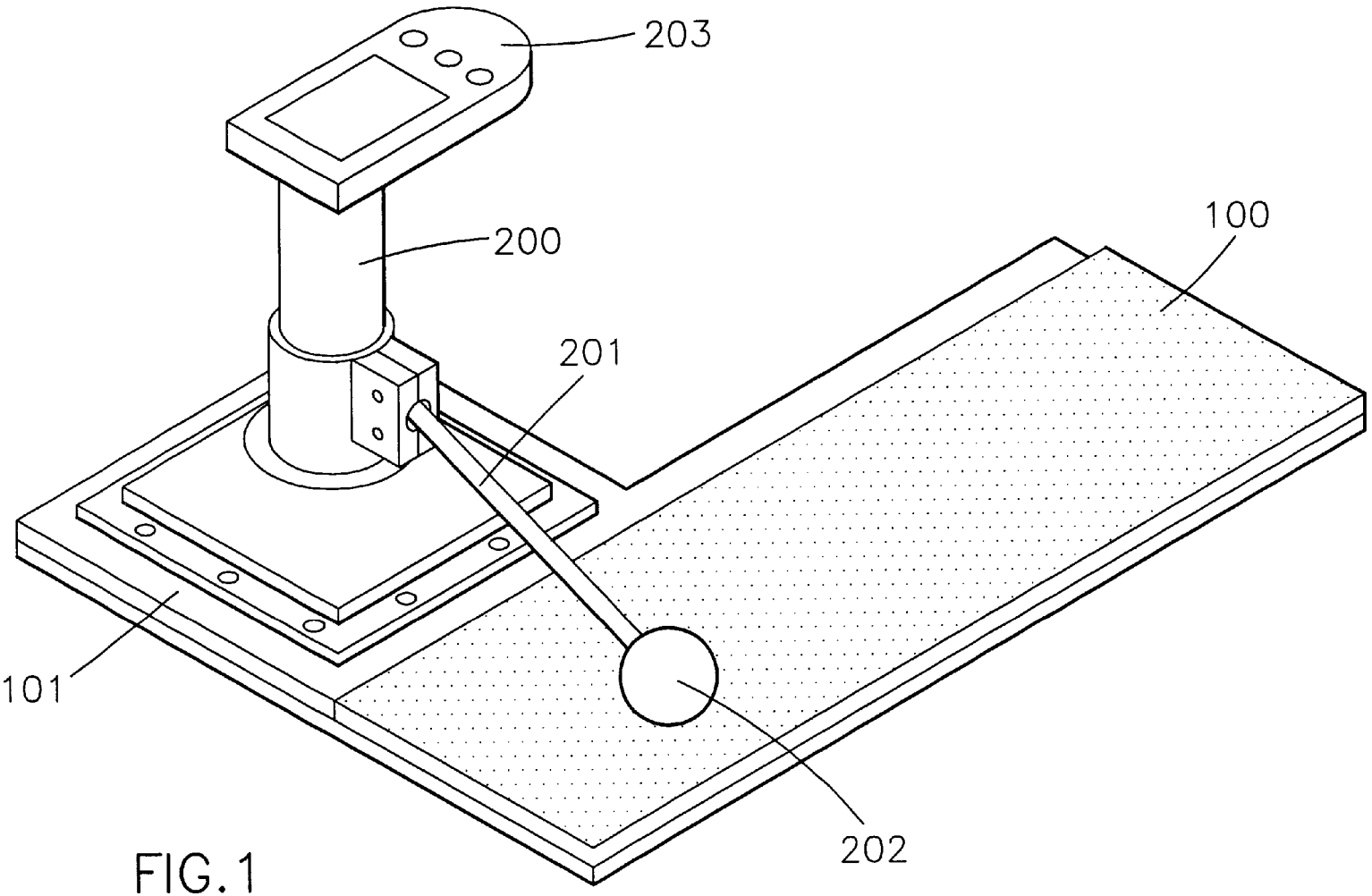
FIG. 1 PRIOR ART
FIG. 1 is a perspective view of a conventional golf swing practicing device in accordance with the present invention.
Figure 2:
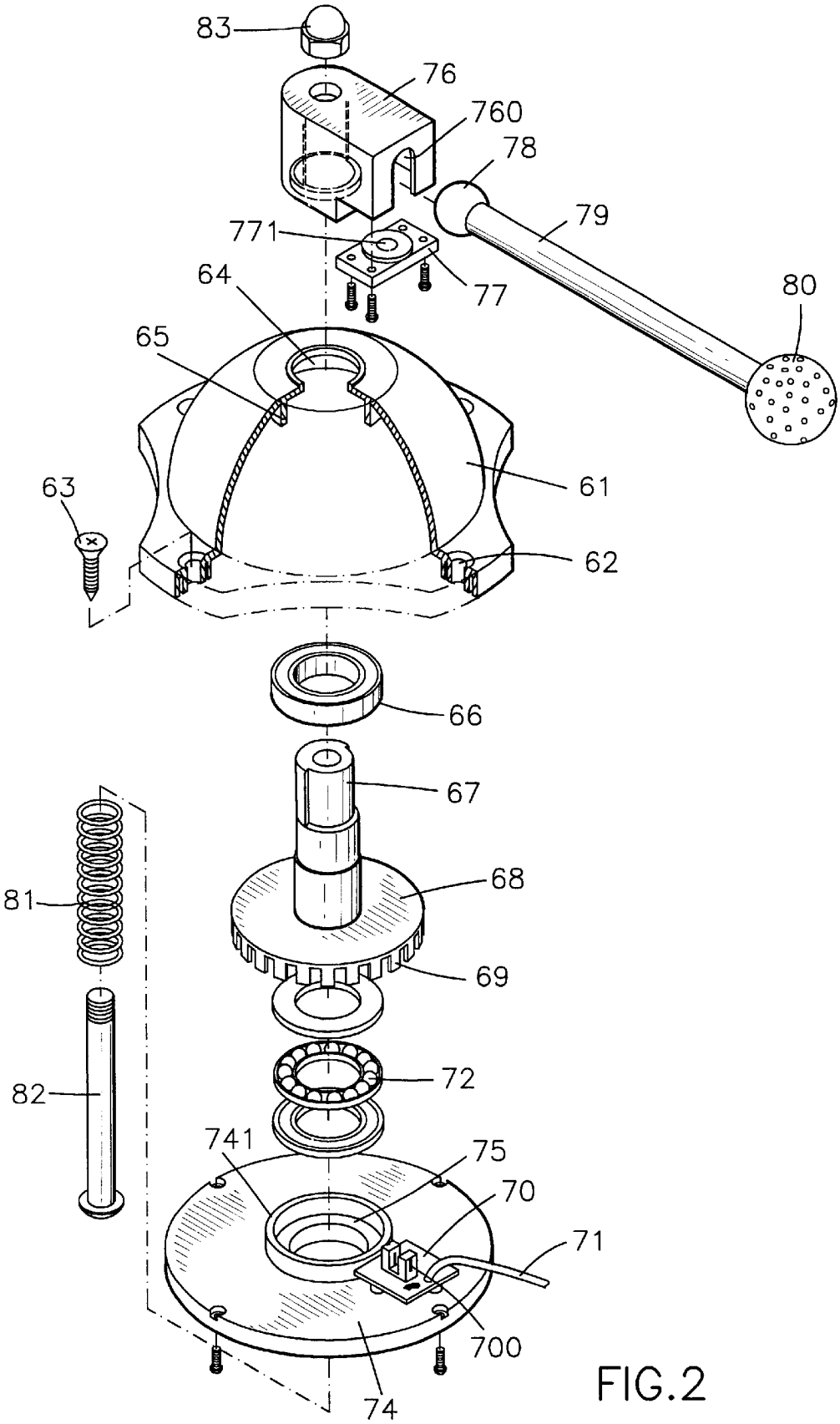
FIG. 2 is an exploded view of the golf swing practicing device in accordance with the present invention.
Figure 3:
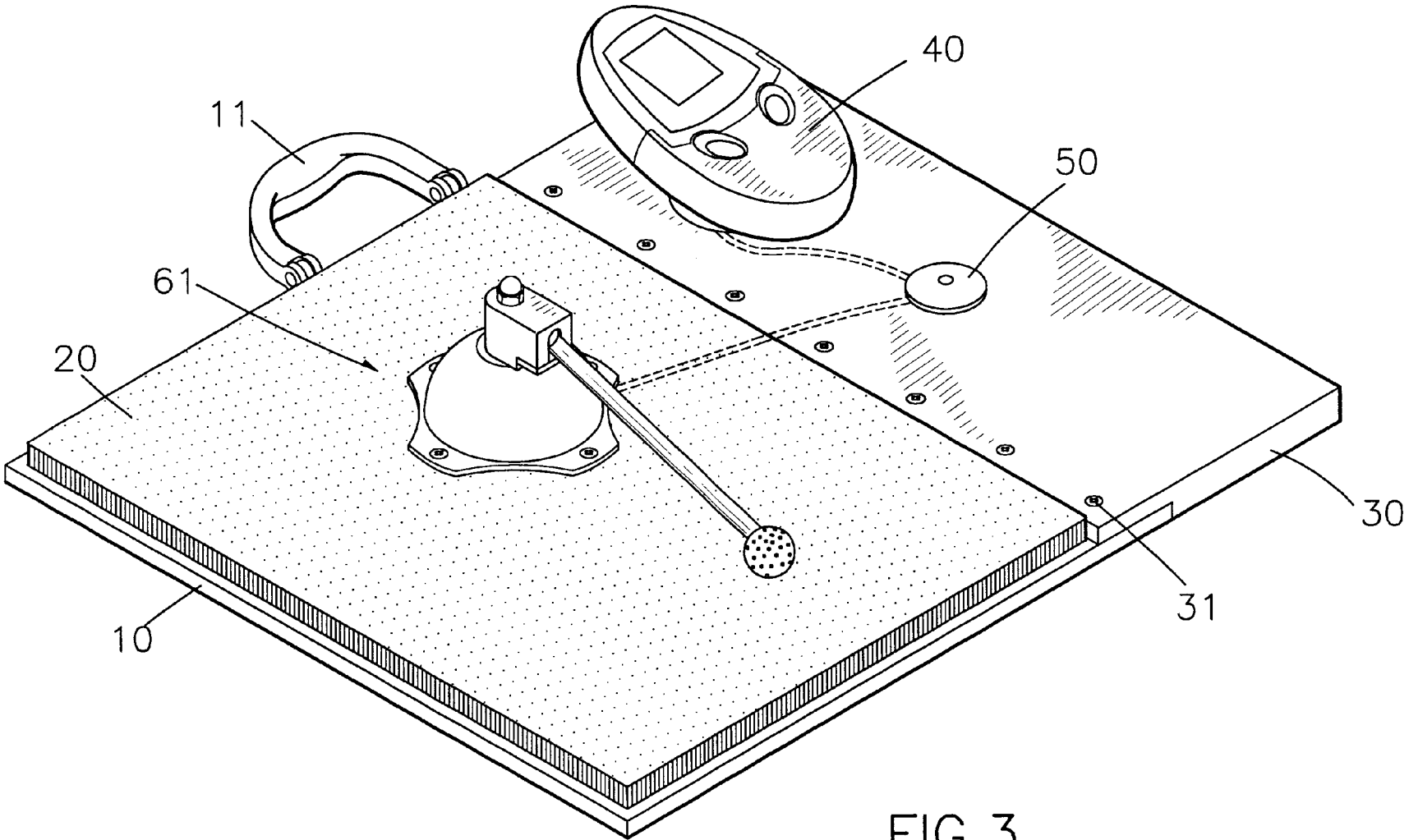
FIG. 3 is a perspective view of the golf swing practicing device in accordance with the present invention.
Figure 4:
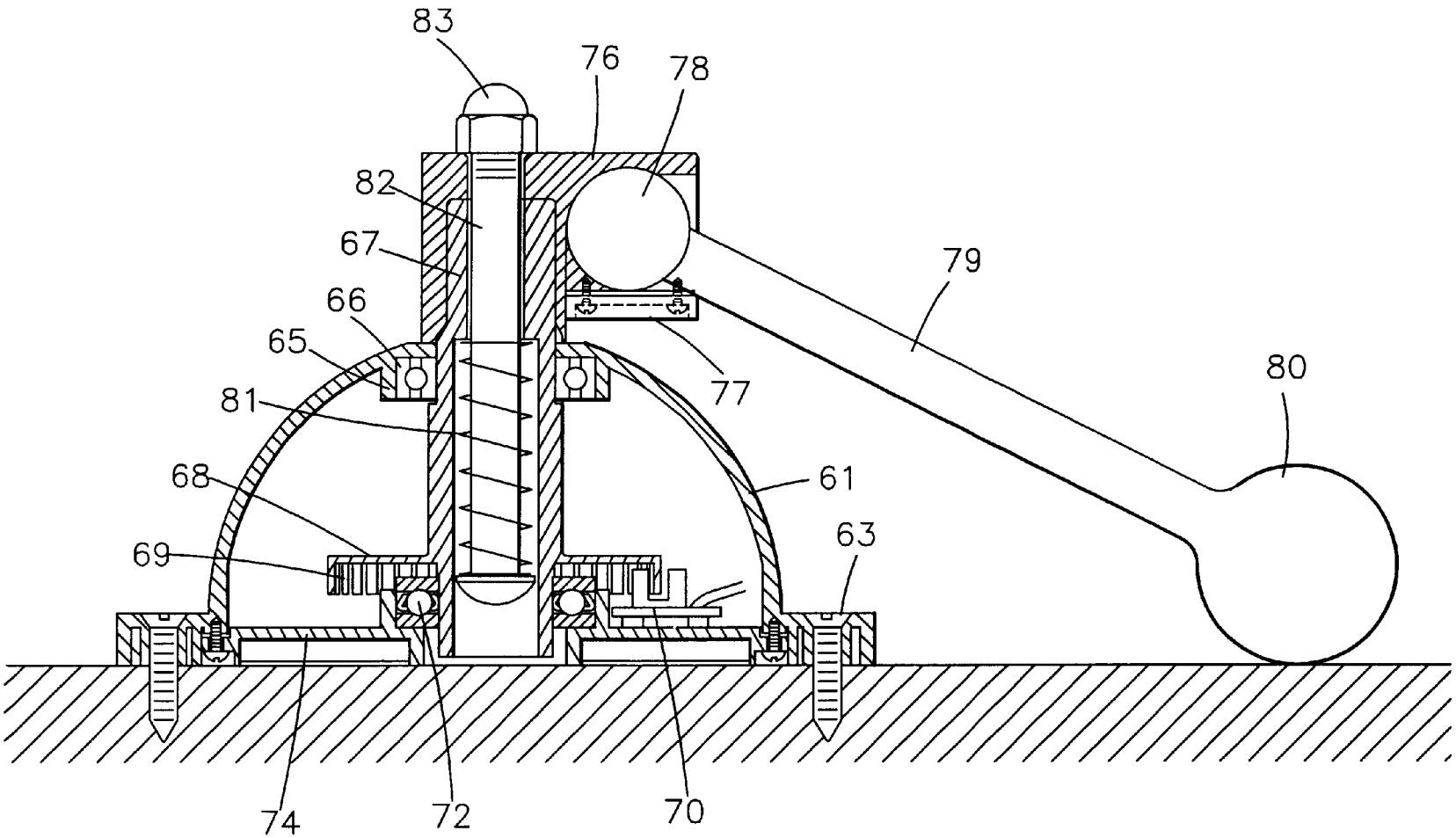
FIG. 4 is a side elevational view, partly in section, of the golf swing practicing device in accordance with the present invention.

Referring to FIGS. 2 to 4, the golf swing practicing device in accordance with the present invention comprises a board 10, which is fixedly connected to side board 30 by bolts 31. A lawn member 20 is put on the board 10, and a handle 11 is connected to a side of the board 10. A base plate 74 is connected on the board 10 and has a hole 75 defined therethrough. A flange 741 extends from the base plate 74 and encloses the hole 75. A bearing 72 is retained in the hole 75, and a sensor 70 is connected on the base plate 74. Two lugs 700 extend from the sensor 70.

A light comb member 68 has a skirt portion and a plurality of comb members 69 extend from one of two sides of the skirt portion. The comb members 69 are movably engaged between the two lugs 700 and a tube 67 extends from the skirt portion. A dome member 61 is fixedly connected to the board 10 by bolts 63 extending through the holes 62 in the flange extending from the dome member 61, and an aperture 64 is defined through the aperture 64. An annular flange 65 extends downward from a periphery of the aperture 64 and a bearing 66 is mounted to the tube 67 and received in the annular flange 65. The tube 67 of the light comb member 68 extends through the aperture 64. A shaft 82 extends through the hole 75 of the board 10 and the tube 67 of the light comb member 68. A torsion spring 81 is mounted to the shaft 82.

A mounting cap 76 is mounted to the top of the shaft 82 which extends through the dome member 61. A nut 83 is threadedly connected to the top of the shaft 82 so that the mounting cap 76 is fixedly connected to the shaft 82 and the light comb member 68. The mounting cap 76 has a notch 760 defined in an end thereof, and a base member 77 is connected to a bottom of the mounting cap 76. The base member 77 has a recess 771 defined therein. One end of a flexible rod 79 has a sphere 78 which is rotatably engaged with the recess 771 within the mounting cap 76 via the notch 760. A golf ball 80 is connected to a distal end of the flexible rod 79. A sensor 70 is connected to the light comb member 68 and a display device 40 is connected to the sensor 70. The sensor 70 has two lugs 700 extending therefrom, and the comb members 69 of the light comb member 68 are movably engaged between the two lugs 700 of the sensor 70. A processing unit 50 is connected between the display device 40 and the sensor 70 by wires 71.

Figure 5:
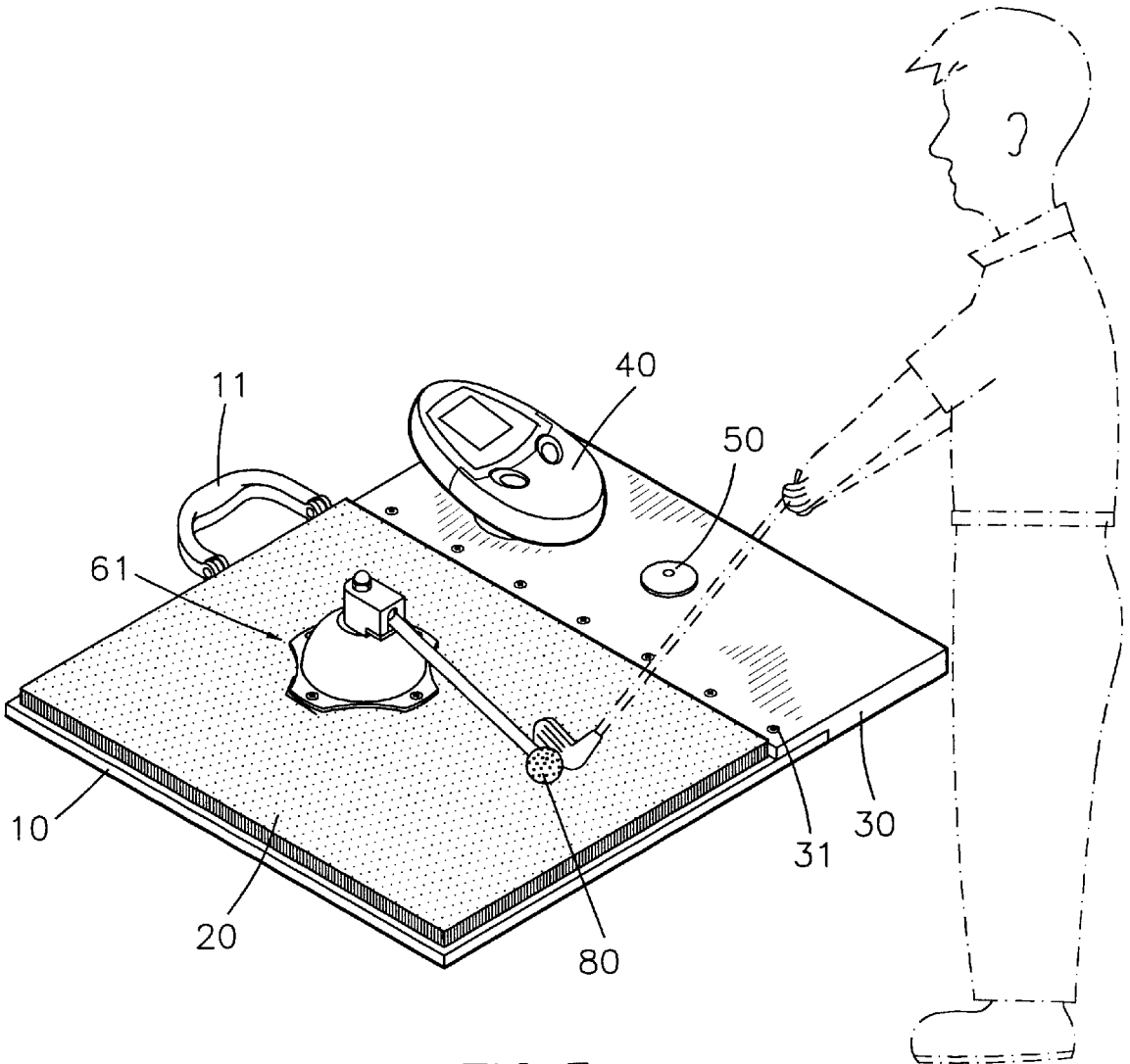
FIG. 5 is an illustrative view showing a player hitting the golf ball of the golf swing practicing device in accordance with the present invention.

Referring to FIG. 5, the device can be easily carried by the handle 11, and the player hits the golf ball 80 by swinging his/her golf club. When hitting the golf ball 80, the mounting cap 76 together with the flexible rod 79 are rotated, and the comb members 69 move between the two lugs 700 of the sensor 70 so that the message is calculated and sent to the display device 40 so that the player knows the result as he hits the golf ball 80.

While various embodiments in accordance with the present invention have been shown and described, it should be clear to those skilled in the art that further embodiments may be made without departing from the scope and spirit of the present invention.

What is claimed is:

1. A golf swing practicing device comprising:

a board having a handle connected to a side thereof and a base plate connected on the board, said base plate having a hole defined therethrough, a flange extending from said base plate and enclosing said hole;

a light comb member having a skirt portion and a plurality of comb members extending from one of two sides of said skirt portion, a tube extending from said skirt portion and a bearing mounted to said tube;

a dome member fixedly connected to said board and having an aperture defined therethrough, said tube of said light comb member extending through said aperture;

a shaft extending through said hole of said board and said tube of said light comb member, a torsion spring mounted to said shaft;

a mounting cap mounted to said shaft extending through said dome member, said mounting cap having a notch defined in an end thereof and a flexible rod rotatably engaged with said notch and a golf ball connected to a distal end of said flexible rod; and a sensor connected to said light comb member and a display device connected to said sensor.

2. The device as claimed in claim 1, wherein said mounting cap has a base member connected to a bottom thereof and said base member has a recess defined therein, said flexible rod having a sphere connected to the other end of said flexible rod so as to be rotatably engaged with said recess.

3. The device as claimed in claim 1, wherein said sensor has two lugs extending therefrom and said comb members of said light comb member are engaged between said two lugs of said sensor.

* * * * *